United States Patent [19]

Araki

[11] 3,954,211

[45] May 4, 1976

[54] POURING CAP FOR LIQUID CONTAINER

[75] Inventor: Shinichi Araki, Sakura, Japan

[73] Assignee: The Lion Fat and Oil Co. Ltd., Tokyo, Japan

[22] Filed: Sept. 6, 1974

[21] Appl. No.: 503,835

[30] Foreign Application Priority Data

Sept. 11, 1973 Japan ..... 48-106984[U]

[52] U.S. Cl. ..... 222/562

[51] Int. Cl.[2] ..... B67D 3/00

[58] Field of Search..... 215/38 R; 222/562, 570, 222/498, 551, 567, 545, 153, 182; 151/27, 28, 49, 50, 12; 285/92, 81, 82

[56] References Cited

UNITED STATES PATENTS

| | | | |
|---|---|---|---|
| 1,339,245 | 5/1920 | Williams | 222/562 X |
| 2,843,350 | 7/1958 | Wilson | 24/213 CS X |
| 3,715,063 | 2/1973 | Susuki et al. | 222/570 X |

*Primary Examiner*—Robert B. Reeves
*Assistant Examiner*—Norman L. Stack, Jr.
*Attorney, Agent, or Firm*—William A. Drucker

[57] ABSTRACT

There is provided a pouring cap for use with a liquid container, which is characterised by its having a lower peripheral end flange formed with a plurality of radial slits around the whole circumference thereof. Thus, the flange may be made relatively large enough in width to permit the pouring cap not only to be easily fitted into an outer container cap but also to be able to remain in secure engagement with the spout portion of the liquid container even after the outer container cap has been removed from the container.

2 Claims, 4 Drawing Figures

(a)

(b)

POURING CAP FOR LIQUID CONTAINER

BRIEF SUMMARY OF THE INVENTION

This invention relates to an improvement to a pouring cap for closing the spout of a liquid container for shampoo or the like.

Conventionally, in the course of production, an inner pouring cap to be attached to the spout of a liquid container usually is previously fitted to the interior of an outer container cap so that the pouring cap thus combined with the outer container cap has its lower opening forced onto the spout portion of a liquid container by a capping machine. In use, only the outer container cap is removed leaving the inner pouring cap alone on the spout of the container. However, the conventional pouring cap generally has its flanged lower peripheral edge relatively small in width, and therefore it has rather poor engagement with the interior of the outer container cap, so that from the aspect of process management, it has poor workability particularly in the capping process.

A particular object of this invention is, therefore, to provide an inner pouring cap which is provided with a special flange, to avoid the above-mentioned disadvantages: that is, it can well engage with the inner wall of an outer cap and also is capable of fitting onto the spout portion of a liquid container so closely as to remain attached thereon without being detached together with the outer cap when the latter is removed from the spout portion.

DETAILED DESCRIPTION OF THE INVENTION

An embodiment according to the invention is described hereinafter with reference to the accompanying drawings.

Figure 1:
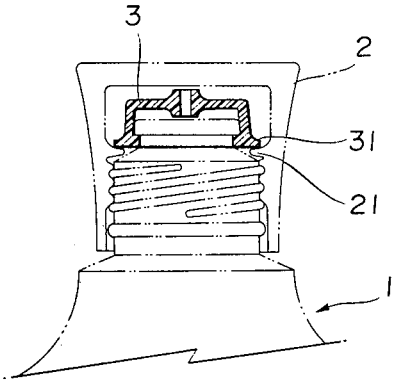
FIG. 1 is a vertical sectional view showing an embodiment of the invention mounted on the spout portion of a liquid container.

FIG. 1 shows an inner pouring cap 3 in engagement with the spout portion of a container 1 which has a spout portion with a relatively larger diameter than its neck portion adjacent the spout portion, and this cap is now fitted on the spout portion by means of a capping machine or the like after having been previously fitted within an outer cap 2. The inner pouring cap 3 which is also fitted in the cap 2 assumes a generally hollow cylindrical configuration, as a whole.

Figure 2:
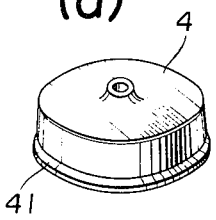
FIG. 2(a) is a perspective view showing a conventional example of inner pouring cap.
FIG. 2(b) is a perspective view showing an embodiment according to the invention.
Figure 2:
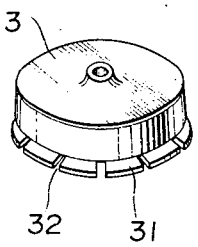

It should be noted that the pouring cap 3 has its lower peripheral edge formed with a generally horizontally radially inwardly and radially outwardly extending annular flange 31 which has its inner peripheral end horizontally fit in said thinner neck portion as shown in FIG. 1. The annular flange 31 has a plurality of radially extending slits 32 around its whole circumference, unlike the conventional pouring cap 31 with a flange 41 as seen in FIG. 2 (a). Due to these slits 32, the flange 31 is flexible, and consequently may be made relatively large in width, so that the flange 31, when unflexed, has the diameter of the outer periphery thereof larger than the inside diameter of an inner annular ridge 21 provided on the inner wall of the cap 2, as explicitly seen in FIG. 1.

Since the flange 31 has a larger width, in order to fit the pouring cap 3 into the outer cap 2, the pouring cap can pass over the inner annular ridge 21 provided on the inner wall of the cap 2 and may rest retained on the ridge. Thus, the pouring cap 3 is positively fitted within the outer cap 2. On the other hand, to remove the outer cap 2, the flange 31 of the pouring cap 3, which is flexible, is flexed outwardly about the lower peripheral end edge of the cap 3 as explicitly supposed from the position of FIG. 3, so that the pouring cap may be left alone on the spout of the container 1 to remain in engagement therewith. In order to exhibit the function of the slits 32 best, it will be sufficient to arrange these slits at equal intervals around the total circumference of the flange without partial arrangement.

Figure 3:
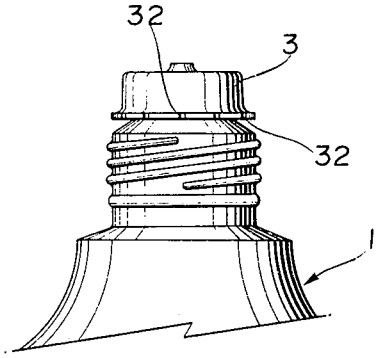
FIG. 3 is a perspective view showing an inner pouring spout according to the invention now mounted on the spout portion of a liquid container.

FIG. 3 shows a position in which the pouring cap 3 is left alone on the container body after the outer cap 2 has been removed.

As described in the foregoing, the pouring cap 3 produces various advantages such as high workability due to its excellent engagement, particularly in the capping process, which would be very advantageous from the aspect of process management, smooth removal of the outer cap 2 with the pouring cap 3 left on the container body 1, and so forth.

Having described specific embodiment of the invention, it is believed obvious that modification and variation of the invention is possible in light of the above teachings.

What I claim is:

1. A pouring cap of generally hollow cylindrical configuration for snap fitting engagement with a liquid container having a spout portion with a larger diameter than its neck region adjacent the spout portion and also adapted for engagement within an outer container cap having an inwardly extending annular ridge provided on the inner wall thereof, said pouring cap comprising:
   - an annular flange generally horizontally radially inwardly and radially outwardly extending from the lower peripheral end edge thereof, having its inner peripheral end for horizontal engagement within said neck portion; and
   - a plurality of radial slits provided in said flange around the whole circumference thereof,
   - said flange having a sufficient radial width of an extent such that said flange, when unflexed, has the diameter of the outer periphery thereof larger than the innermost radial extent of said annular ridge so that said flange, when the pouring cap is fitted within the outer cap, is flexibly bent down to permit said flange to abut said annular ridge of the outer cap and rest retained thereon, and when the outer container cap is removed from the liquid container and is outwardly flexed about the lower peripheral end edge of the pouring cap to have the pouring cap left alone on the spout portion of the container in engagement therewith.

2. The pouring spout as claimed in claim 1, in which said slits are arranged at equal intervals around the entire circumference of said flange.

* * * * *